United States Patent [19]

Mita

[11] Patent Number: 4,798,128

[45] Date of Patent: Jan. 17, 1989

[54] DOUBLE ACTING CYLINDER UNIT

[75] Inventor: Tatsumi Mita, Higashiyamato, Japan

[73] Assignee: Koganei Ltd., Japan

[21] Appl. No.: 72,860

[22] Filed: Jul. 14, 1987

[30] Foreign Application Priority Data

Jul. 16, 1986 [JP] Japan ..... 61-108904[U]

[51] Int. Cl.[4] ..... F01B 29/04

[52] U.S. Cl. ..... 92/59; 92/171

[58] Field of Search ..... 92/59, 171

[56] References Cited

U.S. PATENT DOCUMENTS

| | | | |
|---|---|---|---|
| 3,253,610 | 5/1966 | Pahl | 92/59 |
| 3,818,805 | 6/1974 | Johansson | 92/13.1 |
| 4,046,623 | 9/1977 | Schmid | 92/13.1 |
| 4,050,359 | 9/1977 | Mayer | 92/171 |
| 4,414,881 | 11/1983 | Devaud | 92/128 |
| 4,523,515 | 6/1985 | Smith | 92/59 |
| 4,541,779 | 9/1985 | Birdwell | 92/171 |

*Primary Examiner*—Edward K. Look

*Attorney, Agent, or Firm*—Kane, Dalsimer, Sullivan, Kurucz, Levy, Eisele and Richard

[57] ABSTRACT

A double acting cylinder actuated by air pressure having inner and outer double-wall cylinder tubes. A plurality of pairs of air pressure feed-exhaust ports of the cylinder tubes of this double acting cylinder are concentratedly provided as a pair on the outer periphery at one or opposite ends, or on an end face of the cylinder, respectively. Air communication passages for communicating a pair of feed-exhaust ports with first and second spaces of a cylinder bore can be easily changed by reversing the outer or inner cylinder tube in the axial position thereof. In this case, seal rings are changed in position as necessary, unused feed-exhaust ports are blocked by seal plugs, and only one pair of feed-exhaust ports, which are necessary are connected thereto with air pressure pipings.

4 Claims, 2 Drawing Sheets

DOUBLE ACTING CYLINDER UNIT

BACKGROUND OF THE INVENTION

1. Field of the Invention

This invention relates to cylinder units, particularly to a double acting cylinder unit having inner and outer double-wall cylinder tubes, which form a fluidal path therebetween, and capable of desirably performing piping at the front or rear side of a cylinder, differing in direction from each other.

2. Related Art Statement

The following can be listed as a double acting cylinder unit.

More specifically, it is a double acting cylinder unit including: two spaces in a cylinder bore, partitioned by a piston; a pair of feed-exhaust ports for feeding pressurized fluid into these two spaces so as to drive the piston; and a pair of communication passages for communicating the pair of feed exhaust ports with the two spaces in the cylinder bore. The pair of feed-exhaust ports of this double acting cylinder unit are separately provided on the front and rear sides of the cylinder, or provided on either the front or rear side. For example, as an example of the former, one feed-exhaust port is provided in a rod cover and the other feed-exhaust port is provided in a head cover. In contrast thereto, as an example of the latter, the pair of the feed-exhaust ports are provided in either the rod cover or the head cover.

However, in the former double acting cylinder unit, i.e. the one wherein the pair of the feed-exhaust ports are separately provided on the front and rear sides of the cylinder out of the above-described constructions, the pair of feed-exhaust ports are located at positions separate of each other, whereby routes of pipings connected thereto become so complicated as to require a large piping space, and moreover, the mounting work and maintenance become disadvantageously troublesome.

In this respect, the latter double acting cylinder unit, having the pair of feed-exhaust ports being provided at either the front or rear side, has not the problem as the former double acting cylinder unit has.

However, the latter double acting cylinder unit, having the pair of feed-exhaust ports being provided only at one side of the cylinder, such a disadvantage is presented that piping can be performed only from the feed-exhaust ports positioned at one side, whereby piping from the other side cannot be carried out. For example, should some covering article be present in front of the feed-exhaust ports, piping cannot be carried out.

In this case, it is conceivable that component parts of the double acting cylinder unit are disassembled and suitably reassembled such that the feed-exhaust ports are positioned in the opposite direction. However, in general, in the double acting cylinder unit of the type described, only one pair of communication passages for communicating the pair of feed-exhaust ports with the first and second spaces in the cylinder bore are presupposed, so that it is difficult to easily and quickly change the positions of the feed-exhaust ports by the above-described disassembling and reassembling works.

SUMMARY OF THE INVENTION

The present invention has been developed to obviate the above-described disadvantages, and thus, an object of this invention is to provide a double acting cylinder unit wherein pipings from the front and rear sides of the unit, differing in direction from each other, i.e. pipings from the feed-exhaust ports in different direction, can be discretionally performed, and moreover, change of the feed-exhaust ports in position therefor can be easily, suitably and quickly carried out.

To achieve the above-described object, the present invention contemplates in a double acting cylinder unit wherein a pair of first communication passages for communicating a pair of feed-exhaust ports concentratedly provided at the front side of a cylinder with first and second spaces of a cylinder bore and a pair of second communication passages for communicating a pair of feed-exhaust ports concentratedly provided at the rear side of the cylinder with the first and second spaces of the cylinder bore can be formed by change in the position, direction, arrangement and the like of the component parts of the cylinder unit.

According to the above-described construction, by change in the position and the like of the component parts of the cylinder unit, there may be formed the pair of first communication passages, i.e. the ones for communicating the pair of feed-exhaust ports concentratedly provided at the front side of the cylinder with the first and second spaces in the cylinder bore and the pair of second communication passages, i.e. the ones for communicating the pair of feed-exhaust ports concentratedly provided at the rear side of the cylinder with the first and second spaces in the cylinder bore.

Accordingly, the construction capable of forming the two selective communication passages, i.e. the first and second communication passages, makes it possible to desirably make pipings different in direction from the feed-exhaust ports, positioned either at the front side or at the rear side of the cylinder.

Change in position and the like of the component parts according to the present invention are carried out, for example, by reversing the front and rear of the outer cylinder tube, i.e. the position in the axial direction thereof and further changing the positions of necessary seal rings in association with the reversing.

Furthermore, in another example, a plurality of pairs of feed-exhaust ports, which can be communicated with the first and second spaces in the cylinder bore, respectively, are previously formed on the outer peripheral surface and/or end face of the cylinder unit, only one pair of feed-exhaust ports being most suitable in position are piped as necessary, unnecessary feed-exhaust ports are blocked by seal plugs, the inner cylinder tube is formed therein with a through-hole, which can be communicated with the first or second space of the cylinder bore, and the front and rear of the inner cylinder tube, i.e. the position in the axial direction thereof is reversed, so that pipings from the feed-exhaust ports different in direction can be provided.

Incidentally, the aforesaid and other objects and characteristics of the present invention will become apparent more fully from the following detailed description in conjunction with the accompanying drawings.

DETAILED DESCRIPTION OF THE PREFERRED EMBODIMENTS

Figure 1:
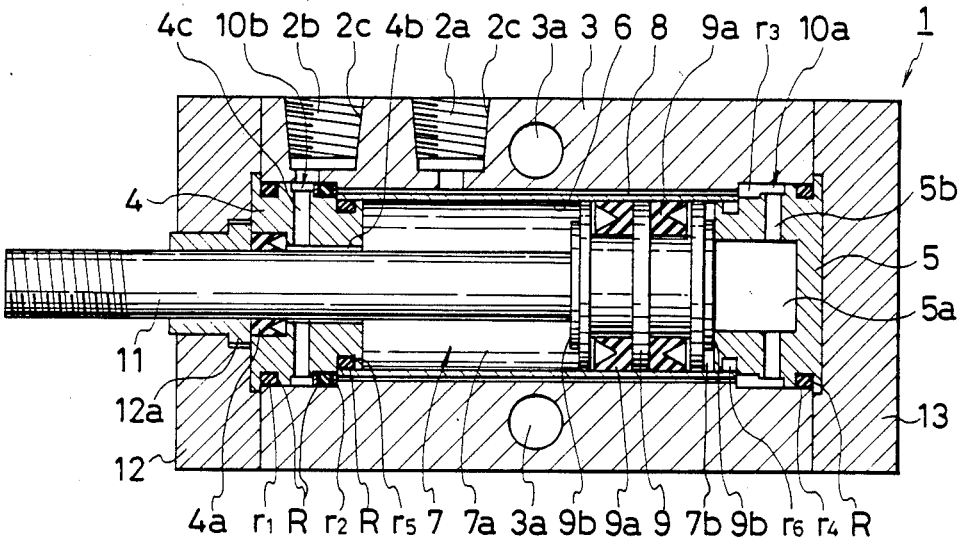
FIG. 1 is a sectional view showing one embodiment of the double acting cylinder unit according to the present invention.

Referring now to the drawings, a double acting cylinder unit 1 of the embodiment shown in FIG. 1 has a main body of a square column in its outer shape. In this double acting cylinder unit 1, a pair of first and second feed-exhaust ports 2*a* and 2*b* are concentratedly provided at the front side, formed on the outer peripheral surface of an outer cylinder tube 3 being of a square shape in cross-section. The first and second feed-exhaust ports 2*a* and 2*b* are each formed therein with an internally threaded portion 2*c*, into which is threadably coupled an externally threaded piping connector, not shown, so that pipings can be connected to these feed-exhaust ports.

In the outer cylinder tube 3, a packing housing 4 and a head cover 5 are detachably coupled to the front and rear ends of a cylindrical hollow portion therein. Gastightnesses of the packing housing 4 and the head cover 5 to the outer cylinder tube 3 are held by coupling O-rings R into O-ring grooves r1, r2, r3 and r4, which are circumferentially formed on the packing housing 4 and the head cover 5. Incidentally, out of these O-ring grooves, there may be one which functions as a fluidal path by not being coupled thereinto with an O-ring R. The example in this embodiment is the O-ring groove r3 of the head cover 5 shown in FIG. 1.

An inner cylinder tube 6 is located in the outer cylinder tube 3 at a position spaced a predetermined distance apart from the inner peripheral surface of the outer cylinder tube 3. The end portions of the packing housing 4 and the head cover 5 are detachably coupled to the front and rear ends of the interior of the inner cylinder tube 6, respectively. Gastightnesses can be held by coupling O-rings R into O-ring grooves r5 and r6, which are circumferentially formed on the opposite end portions of the packing housing 4 and the head cover 5.

A cylinder bore 7 is defined by the inner cylinder tube 6, packing housing 4 and head cover 5. Provided around the outer periphery of the cylinder bore 7 is first flow path 8 of a ring shape in cross-section, defined by the inner peripheral surface of the outer cylinder tube 3 and the outer peripheral surface of the inner cylinder tube 6, and this flow path 8 is directly communicated with the first feed-exhaust port 2*a* of the outer cylinder tube 3.

Furthermore, positioned in the cylinder bore 7 of the inner cylinder tube 6 is a piston 9 slidably movable in the axial direction of the cylinder bore 7. The cylinder bore 7 is partitioned into first space 7*a* and second space 7*b* by the piston 9. The latter second space 7*b* includes a hollow portion 5*a* in the head cover 5. Two second flow paths 5*b* extend from the hollow portion 5*a* in this head cover 5 in the radial direction of the head cover 5 and reach the outside of the head cover 5. The second flow paths 5*b* are connected to the first flow path 8 through the O-ring groove r3 of the head cover 5, into which is not coupled an O-ring R. As a consequence, the first feed-exhaust port 2*a* of the outer cylinder tube 3 is communicated with the second space 7*b* through first communication passage 10*a* constituted by the first flow path 8, the O-ring groove r3 of the head cover 5 and the second flow paths 5*b*.

The piston 9 is circumferentially provided thereon with two piston packings 9*a*. The piston 9 is formed at the front and rear end faces thereof with stepped portions 9*b*, so that, when the inner end faces of the packing housing 4 and the head cover 5 are brought into abutting contact with the front and rear end faces of the piston 9, the members 4 and 5 cannot be firmly attached thereto. Further, extending from the front end face of the piston 9 is a piston rod 11, which projects to the outside of the cylinder unit, penetrating through the packing housing 4 and a rod cover 12.

A through-hole formed in the packing housing 4, through which the piston rod 11 extends, has an inner diameter larger than an outer diameter of the piston rod 11.

Furthermore, the front end side of the through-hole of the packing housing 4 is formed to have a larger diameter and the rear end side of the through-hole is formed to have a smaller diameter A rod packing 4*a* is coupled into the larger diameter portion at the front end side of the through-hole, so that gastightness of the first space 7*a* of the cylinder bore 7 can be held. On the other hand, the inner peripheral surface of the smaller diameter portion at the rear end side of the through-hole is spaced a predetermined distance apart from the outer peripheral surface of the piston rod 11, whereby this spaced portion forms third flow path 4*b* being of a ring shape in cross-section. This third flow path 4*b* is directly communicated with the first space 7*a*. In the packing housing 4, two fourth flow paths 4*c* are provided, extending from the third flow path 4*b* in the radial direction and reaching the outside of the packing housing 4. The fourth flow paths 4*c* are directly communicated with the second feed-exhaust port 2*b*.

As a consequence, the second feed-exhaust port 2*b* of the outer cylinder tube 3 is communicated with the first space 7*a* through first communication passage 10*b* constituted by the third flow path 4*b* and the fourth flow paths 4*c*. In contrast thereto, the first feedexhaust port 2*a* of the outer cylinder tube 3 is not communicated with the first communication passage 10*b* which is communicated with the first space 7*a*, because communication between the first flow path 8 and the fourth flow paths 4*c* is blocked by an O-ring R coupled into the O-ring groove r2 at the center of the packing housing 4.

Here, the rod cover 12 at the front end of the double acting cylinder unit 1 has an oilless bush 12*a*. This rod cover 12 is threadably coupled to the front end face of the outer cylinder tube 3, to thereby fix the packing housing 4. On the other hand, a fixing cover 13 is provided on the rear end of the double acting cylinder unit 1. This fixing cover 13 is threadably coupled to the rear end face of the outer cylinder tube 3, to thereby fix the head cover 5. Incidentally, mounting holes 3*a* for mounting the cylinder unit to a predetermined machinery, not shown, are formed through in the outer cylinder tube 3 in a direction of crossing the axis of the cylinder unit.

Action of this embodiment will hereunder be described.

FIG. 1 shows a state where the piston 9 is brought into abutting contact with the head cover 4. In this state, when compressed air is fed into the first feed-exhaust port 2*a* communicated with the second space 7*b* through the first communication passage 1O*a*, the piston 9 moves to the left in FIG. 1, whereby the piston rod 11 projects to the outside of the cylinder unit. On the contrary, when compressed air is fed into the second feed-exhaust port 2b communicated with the first space 7a through the first communication passage 10b, the piston 9 moves to the right in FIG. 1, whereby the piston rd 11 is retracted into the cylinder unit.

As described above, compressed air is fed into either the first feed-exhaust port 2a or the second feed-exhaust port 2b, whereby the piston rod 11 is caused to perform a predetermined reciprocatory motion, so that a load connected to or brought into abutting contact with the outer end of the piston rod 11 can be driven.

Figure 2:
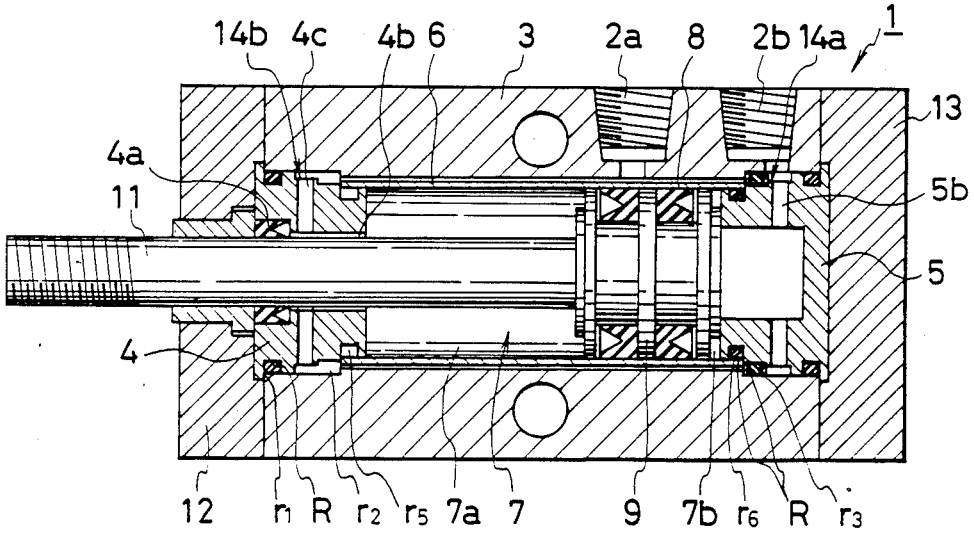
FIG. 2 is a sectional view showing a state where a pair of feed-exhaust ports are provided at the rear side of the double acting cylinder unit shown in FIG. 1.

Description will hereunder be given of an example where the double acting cylinder unit 1, wherein the first and second feed-exhaust ports 2a and 2b are provided at the front side of the cylinder as shown in FIG. 1, is changed into the double acting cylinder unit 1, wherein the first and second feed-exhaust ports 2a and 2b are provided at the rear side of the cylinder as shown in FIG. 2. The rod cover 12 and the fixing cover 13, which are threadably coupled to the front and rear end faces of the outer cylinder tube 3, respectively, are threadably untightened and removed from the outer cylinder tube 3. Subsequently, the head cover 5 and the packing housing 4, which are coupled to the outer cylinder tube 3 and the inner cylinder tube 6, are removed therefrom.

Then, two O-rings R, which are coupled into the O-ring grooves r5 and r2 positioned at the rear end side and the intermediate portion of the packing housing 4, are removed. After the above-described disassembling works, the following assembling works will be carried out.

Two O-rings R are coupled into the O-ring grooves r3 and r6, which are positioned at the front end side and the intermediate portion of the head cover 5, respectively, and thereafter, the packing housing 4, the inner cylinder tube 6 and the head cover 5 are inserted into the outer cylinder tube 3 such that the outer cylinder tube 3 is longitudinally or axially reversed relative to the previous state thereof, i.e. the first and second feed-exhaust ports 2a and 2b are positioned at the rear side. Finally, the rod cover 12 and the fixing cover 13 are threadably coupled to the outer cylinder tube 3. As shown in FIG. 2, in the double acting cylinder unit 1 thus reassembled, the first and second feed-exhaust ports 2a and 2b are provided at the rear side of the cylinder. Furthermore, differing from the state shown in FIG. 1, the second feed-exhaust port 2b is communicated with the second space 7b through second communication passage 14a constituted by the second flow paths 5b, and the first feed-exhaust port 2a is communicated with the first space 7a through second communication passage 14b constituted by the first flow path 8, the O-ring groove r5 in the intermediate portion of the packing housing 4, the fourth flow paths 4c and the third flow path 4b. Driving of the double acting cylinder unit 1 thus changed is made similarly to the one described in FIG. 1, so that description of driving will not be repeated.

Figure 3:
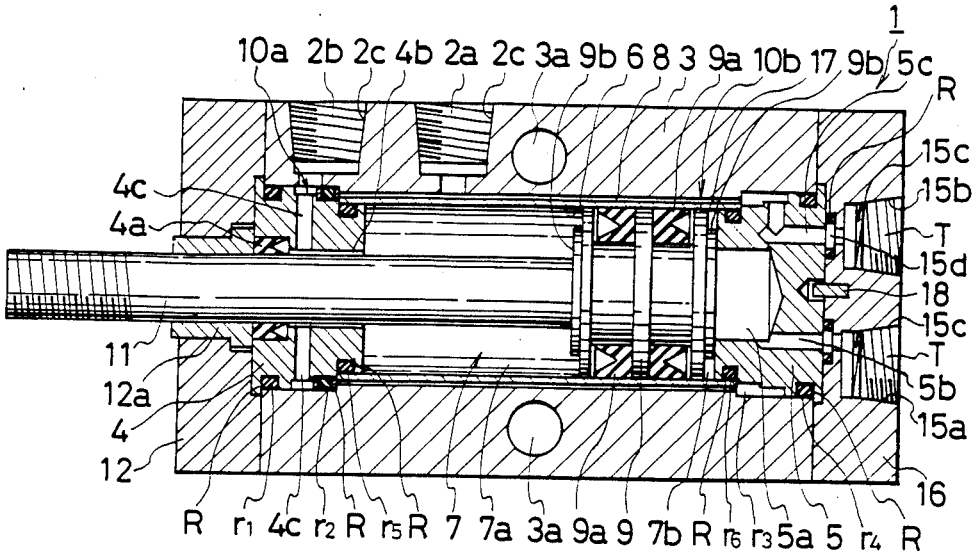
FIG. 3 is a sectional view showing another embodiment of the double acting cylinder unit according to the present invention.
Figure 4:
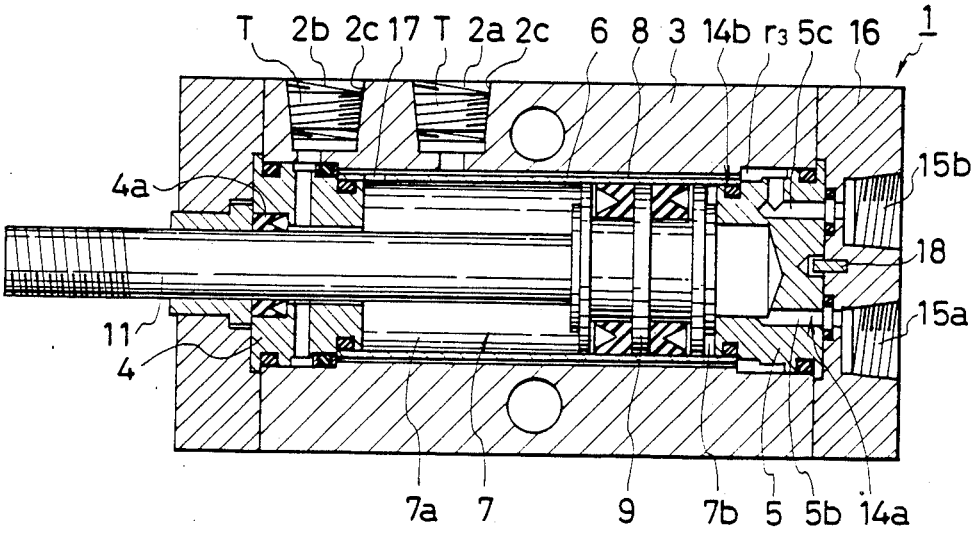
FIG. 4 is a sectional view showing a state where a pair of feed-exhaust ports are provided at the rear side of the double acting cylinder unit shown in FIG. 3.

FIG. 3 is the sectional view showing another embodiment of the double acting cylinder unit according to the present invention. FIG. 4 is the sectional view showing the state where the pair of feed-exhaust ports of the double acting cylinder unit shown in FIG. 3 are provided at the rear side.

The double acting cylinder unit in this embodiment will be described with reference to FIG. 3.

The double acting cylinder unit 1 in this embodiment has a main body being of a square column in its outer shape. In this double acting cylinder unit 1, a pair of first and second feed-exhaust ports 2a and 2b are provided at the front side, and a pair of third and fourth feed-exhaust ports 15a and 15b are provided at the rear side, respectively. These first and second feed-exhaust ports 2a and 2b are provided on the outer peripheral surface of an outer cylinder tube 3, and these third and fourth feed-exhaust ports 15a and 15b are provided on a piping adapter 16 located at the rear end of the double acting cylinder unit 1, respectively. These first, second, third and fourth feed-exhaust ports 2a, 2b, 15a and 15b are formed therein with internally threaded portions 2c and 15c, respectively. These internally threaded portions 2c and 15c are selectively threadably coupled thereinto with piping connectors, not shown, or seal plugs T, which are externally threaded, so that pipings can be connected thereto or sealings can be made by the plugs. In FIG. 3, the above-described seal plugs T are threadably coupled to the third and fourth ports 15a and 15b. Incidentally, these third and fourth feed-exhaust ports 15a and 15b are provided with O-ring grooves 15d, into which O-rings R are coupled.

A packing housing 4 and a head cover 5 are detachably coupled to the front and rear ends of the cylindrical hollow portion of the outer cylinder tube 3. Gastightness of the packing housing 4 and the head cover 5 to the outer cylinder tube 3 can be held by coupling O-rings R into O-ring grooves r1, r2, r3 and r4 which are circumferentially provided on these members 4 and 5.

Furthermore, an inner cylinder tube 6 is located in the outer cylinder tube 3 at the position spaced the predetermined distance apart from the inner peripheral surface of the outer cylinder tube 3. The end portions of the packing housing 4 and the head cover 5 are detachably coupled to the front and rear ends of the interior of the inner cylinder tube 6, respectively. Gastightness thereof can be held by coupling the O-rings R into O-ring grooves r5 and r6 which are circumferentially formed on the end portions of the packing housing 4 and the head cover 5.

A cylinder bore 7 is defined by the inner cylinder tube 6, packing housing 4 and head cover 5. Provided around the outer periphery of the cylinder bore 7 is first flow path 8 of a ring shape in cross-section, defined by the inner peripheral surface of the outer cylinder tube 3 and the outer peripheral surface of the inner cylinder tube 6, and this flow path 8 is directly communicated with the first feed-exhaust port 2a of the outer cylinder tube 3.

Furthermore, positioned in the cylinder bore 7 in the inner cylinder tube 6 is a piston 9 slidably movable in the axial direction of the cylinder bore 7. The cylinder bore 7 is partitioned into first space 7a and second space 7b by the piston 9. The latter second space 7b includes the hollow portion 5a of the head cover 5. This second space 7b is communicated with the first flow path 8 through a through-hole 17 positioned at the rear end of the inner cylinder tube 6.

Second flow path 5b extends from the hollow portion 5a of this head cover 5 toward the rear end of the head cover 5 and reaches the outside of the head cover 5. The second flow path 5b is directly communicated with the third feed-exhaust port 15a of the piping adapter 16. Accordingly, the third feed-exhaust port 15a can be communicated with the second space 7b through the second flow path 5b. Furthermore, an L-shaped fifth flow path 5c is formed in the head cover 5. This fifth flow path 5c is directly communicated at one end thereof with the fourth feed-exhaust port 15b and at the other end thereof with the O-ring groove in the intermediate portion of the head cover 5, i.e. the O-ring groove r3, into which no O-ring is coupled. Further, this O-ring groove r3 is directly communicated with the rear end of the first flow path 8.

The piston 9 is circumferentially provided thereon with two piston packings 9a. Furthermore, the piston 9 is formed at the front and rear end faces thereof with stepped portions 9b, so that, when the inner end faces of the packing housing 4 and the head cover 5 are brought into abutting contact with the front and rear end faces of the piston 9, the members 4 and 5 cannot be firmly attached thereto. Further, extending from the front end face of the piston 9 is a piston rod 11, which projects to the outside of the cylinder unit, penetrating through the packing housing 4 and a rod cover 12.

The through-hole formed in the packing housing 4, through which the piston rod 11 extends, has an inner diameter larger than an outer diameter of the piston rod 11.

Furthermore, the through-hole of the packing housing is formed at the front end thereof with a diameter larger than a diameter at the rear end thereof. A rod packing 4a is coupled into the larger diameter portion at the front end of the through-hole, so that gastightness of the first space 7a of the cylinder bore 7 can be held. On the other hand, the inner peripheral surface of the smaller diameter portion at the rear end of the through-hole is spaced the predetermined distance apart from the outer peripheral surface of the piston rod 11, whereby this spaced portion forms third flow path 4b being of the ring shape in cross-section. This third flow path 4b is directly communicated with the first space 7a. In the packing housing 4, the two fourth flow paths 4c are provided, extending from the third flow path 4b in the radial direction and reaching the outside of the packing housing 4. The fourth flow paths 4c are directly communicated with the second feedexhaust port 2b of the outer cylinder tube 3.

As a consequence, the second feed-exhaust port 2b of the outer cylinder tube 3 is communicated with the first space 7a through first communication passage 10a constituted by the third flow path 4b and the fourth flow path 4c. In contrast thereto, the first feedexhaust port 2a of the outer cylinder tube 3 is not communicated with the first communication passage 10a because communication between the first flow path 8 and the fourth flow path 4c is blocked by the O-ring R coupled into the O-ring groove r2 at the center of the packing housing 4.

However, the first feed-exhaust port 2a is communicated with first communication passage 10b constituted by the first flow path 8 and the through-hole 17 formed in the inner cylinder tube 6, and further, communicated with the second space 7b through the first communication passage 10b.

Here, a rod cover 12 at the front end of the double acting cylinder unit 1 has an oilless bush 12a. This rod cover 12 is threadably coupled to the front end face of the outer cylinder tube 3, to thereby fix the packing housing 4. Furthermore, the piping adapter 16 at the rear end of the double acting cylinder unit 1 is threadably coupled to the rear end face of the outer cylinder tube 3, to thereby fix the head cover 5. A rotation-preventing pin 18 is provided eccentrically between the head cover 5 and the piping adapter 16 to prevent rotation of said head cover 5. Incidentally, mounting holes 3a for mounting the cylinder unit to the predetermined machinery, not shown, are formed through in the outer cylinder tube 3.

Action of this embodiment will hereunder be described.

FIG. 3 shows the state where the piston 9 is in abutting contact with the head cover 5. In this state, when compressed air is fed into the first feed-exhaust port 2a communicated with the second space 7b through the first communication passage 10b, the piston 9 moves from the state shown in FIG. 3 to the left in FIG. 3, whereby the piston rod 11 projects to the outside of the cylinder unit.

On the contrary, when compressed air is fed into the second feed-exhaust port 2b communicated with the first space 7a through the first communication passage 10a, the piston 9 moves to the right in FIG. 3, whereby the piston rod 11 is retracted into the cylinder unit.

As described above, compressed air is fed into either the first feed-exhaust port 2a or the second feed-exhaust port 2b, whereby the piston rod 11 is caused to perform the predetermined reciprocatory motion, so that a load connected to or brought into abutting contact with the outer end of the piston rod 11 can be driven.

Description will hereunder be given of an example where the double acting cylinder unit 1, wherein the first and second feed-exhaust ports 2a and 2b, which are open, are provided at the front side of the cylinder as shown in FIG. 3, i.e. the double acting cylinder unit in which fluid such as air is fed or exhausted by the first and second feed-exhaust ports 2a and 2b, is changed into the double acting cylinder unit, wherein fluid such as air is fed or exhausted by the third and fourth feed-exhaust ports 15a and 15b as shown in FIG. 4. The rod cover 12 and the piping adapter 16, which are threadably coupled to the front and rear end faces of the outer cylinder tube 3, are threadably untightened and removed from the outer cylinder tube 3. Subsequently, the head cover 5 and the packing housing 4, which are coupled to the outer cylinder tube 3 and the inner cylinder tube 6, are removed therefrom.

After the above-described disassembling works, the following assembling works will be carried out.

The packing housing 4 and the head cover 5 are coupled to the opposite ends of the inner cylinder tube 6, respectively, such that the inner cylinder tube 6 is longitudinally or axially reversed relative to the previous state thereof, i.e. the through-hole 17, which has been positioned at the rear side, is relocated at the front side. In this state, the through-hole 17 of the inner cylinder tube 6 is positioned on the side of the packing housing 4.

Subsequently, the packing housing 4, the inner cylinder tube 6 and the head cover 5, which are coupled to one another as described above, are inserted into the outer cylinder tube 3, and thereafter, the rod cover 12 and the piping adapter 16 are threadably coupled to the front and rear ends of the outer cylinder tube 3. Furthermore, the seal plugs T, which have plugged the third and fourth feed-exhaust ports 15a and 15b of the piping adapter 16, are removed, whereby the third and fourth feed-exhaust ports 15a and 15b are opened. On the other hand, the first and second feed-exhaust ports 2a and 2b, which have been open, of the outer cylinder tube 3 are threadably coupled to internally threaded portions 2c thereof with the seal plugs T, to thereby be plugged.

As shown in FIG. 4, in the double acting cylinder unit thus reassembled, the third and fourth feed-exhaust ports 15*a* and 15*b*, which are open, are provided at the rear side of the cylinder. Furthermore, the third feed-exhaust port 15*a* is communicated with the second space 7*b* through second communication passage 14*a* constituted by the second flow path 5*b*. On the other hand, the fourth feed-exhaust port 15*b* is communicated with first space 7*a* through second communication passage 14*b* constituted by the fifth flow path 5*c*, the O-ring groove r3 in the intermediate portion of the head cover 5, the first flow path 8 and the through-hole 17 of the inner cylinder tube 6.

In this state shown in FIG. 4, when compressed air is fed into the third feed-exhaust port 15*a*, the piston 9 moves to the left in FIG. 4 from the state shown in FIG. 4, whereby the piston rod 11 projects to the outside of the cylinder unit. On the contrary, when compressed air is fed into the fourth feed-exhaust port 15*b*, the piston 9 moves to the right in FIG. 4, whereby the piston rod 11 is retracted into the cylinder unit. As described above, the piston rod 11 is caused to perform the predetermined reciprocatory motion, so that the load connected to or brought into abutting contact with the outer end of the piston rod 11 can be driven.

Incidentally, the present invention need not necessarily be limited to the above embodiments, and other various modifications can be adopted. For example, the outer cylinder tube may be formed into a cylindrical shape or any of other shapes different from one another in cross-section.

According to the present invention, in a cylinder unit including inner and outer cylinder tubes and first and second spaces of the cylinder bore, which are partitioned in the inner cylinder tube, such an arrangement is adopted that a pair of first communication passages for communicating a pair of feed-exhaust ports concentratedly provided at the front side of the cylinder with the first and second spaces, respectively, and a pair of second communication passages for communicating a pair of feed-exhaust ports concentratedly provided at the rear side of the cylinder with the first and second spaces, respectively, can be formed by change of the component parts of the cylinder unit, thereby achieving the following advantages. (1) By change of the component parts of the cylinder unit, e.g. change of the outer and inner cylinder tubes in position, the first and second communication passages can be selectively formed, so that the feedexhaust ports can be desirably provided either at the front or rear side of the cylinder unit and pipings can be made thereto. Accordingly, the degree of flexibility in piping can be increased considerably. (2) Such an arrangement is adopted that the pair of first communication passages and the pair of second communication passages, which can be formed by change of the component part of the cylinder unit are previously incorporated in the cylinder unit, so that the positions of the feed-exhaust ports to be communicated therewith can be easily, suitably and quickly changed.

What is claimed is:

1. A double acting cylinder unit having a front end and a rear end, comprising:

concentric inner and outer cylinder tubes forming there between a fluid path;

a piston positioned in the bore of said inner cylinder tube partitioning said inner cylinder tube into first and second spaces;

a pair of feed-exhaust ports located near one end of said outer cylinder tube;

a first pair of communication passages for communicating one of said feed-exhaust ports with said first space and the other of said ports with said second space when said outer cylinder tube is oriented with said feed-exhaust ports proximal the front end of said unit; and a second pair of communication passages for communicating the other of said feed-exhaust ports with said first space and said one port with said second space when said outer cylinder tube is oriented with said feed-exhaust ports proximal the rear end of said unit.

2. The invention in accordance with claim 1 further including first seal ring means for blocking said first pair of communicating passages from each other and second seal ring means for blocking said second pair of communication passages from each other.

3. The invention in accordance with claim 2 wherein said first seal ring means and said second seal ring means are reversed in function when the orientation of said outer cylinder with respect to the front rear ends is reversed.

4. The invention as set forth in claim 2 further comprising a plurality of pairs of feed-exhaust ports formed on the outer peripheral surface and/or at an end of said cylinder; said pairs of feed-exhaust ports being adapted to communicate with said first and second spaces in the cylinder bore whereby one selected pair of said feed-exhaust ports may be connected to a fluid source and unselected pairs of said feed-exhaust ports are blocked by seal plugs; and said inner cylinder tube is formed with a through-hole which can communicate with said first or second space in said cylinder bore.

* * * * *